US009558705B2

(12) United States Patent
Kim

(10) Patent No.: US 9,558,705 B2
(45) **Date of Patent: *Jan. 31, 2017**

(54) FLAT PANEL DISPLAY DEVICE CONTROLLING INITIALIZATION OF DATA LINES SUPPLIED TO A PIXEL UNIT

(71) Applicant: Samsung Display Co., Ltd., Yongin, Gyeonggi-Do (KR)

(72) Inventor: Yang-Wan Kim, Yongin (KR)

(73) Assignee: Samsung Display Co., Ltd., Samsung-ro, Giheung-Gu, Yongin-si, Gyeonggi-do (KR)

( * ) Notice: Subject to any disclaimer, the term of this patent is extended or adjusted under 35 U.S.C. 154(b) by 273 days.

This patent is subject to a terminal disclaimer.

(21) Appl. No.: 13/939,017

(22) Filed: Jul. 10, 2013

(65) Prior Publication Data

US 2014/0191931 A1 Jul. 10, 2014

(30) Foreign Application Priority Data

Jan. 10, 2013 (KR) ..... 10-2013-0002733

(51) Int. Cl.
*G09G 3/32* (2016.01)
*G09G 3/36* (2006.01)

(52) U.S. Cl.
CPC ..... *G09G 3/3685* (2013.01); *G09G 3/3291* (2013.01); *G09G 2310/0297* (2013.01)

(58) Field of Classification Search
CPC ..... G09G 3/3685
See application file for complete search history.

(56) References Cited

U.S. PATENT DOCUMENTS

2006/0151745 A1* 7/2006 Kim et al. ..... 252/301.16
2008/0150844 A1* 6/2008 Choi ..... G09G 3/3233 345/76

(Continued)

FOREIGN PATENT DOCUMENTS

CN 101206835 A 6/2008
JP 2010020048 A * 1/2010

(Continued)

OTHER PUBLICATIONS

Taiwanese Office Action issued by Taiwanese Patent Office on Nov. 10, 2016 for Taiwanese patent application No. 102128626 and Request for Entry of the Accompanying Office Action attached herewith.

*Primary Examiner* — Joseph Feild
*Assistant Examiner* — Karin Kiyabu
(74) *Attorney, Agent, or Firm* — Robert E. Bushnell, Esq.

(57) ABSTRACT

A flat panel display device includes a pixel unit having scan-lines, data-lines, and first through third pixels that are coupled to the scan-lines and the data-lines, a scan driver that applies a scan signal to the pixel unit, a data driver that selectively applies a first data signal, a second data signal, a third data signal, and an initialization signal to the pixel unit, a demultiplexing unit having at least one demultiplexer that applies the first data signal, the second data signal, and the third data signal to the first pixels, the second pixels, and the third pixels, respectively, and that simultaneously applies the initialization signal to the first through third pixels, and a timing control unit that controls the scan driver, the data driver, and the demultiplexing unit.

11 Claims, 9 Drawing Sheets

(56) References Cited

U.S. PATENT DOCUMENTS

| | | | | |
|---|---|---|---|---|
| 2011/0164071 | A1 | 7/2011 | Chung et al. | |
| 2012/0013597 | A1 | 1/2012 | Han | |
| 2014/0152639 | A1* | 6/2014 | Bang | G09G 3/3233 345/212 |
| 2014/0307004 | A1* | 10/2014 | Roh | G09G 3/3266 345/690 |

FOREIGN PATENT DOCUMENTS

| | | | |
|---|---|---|---|
| KR | 1020060024869 | A | 3/2006 |
| KR | 1020110080040 | A | 7/2011 |
| KR | 1020120009579 | A | 2/2012 |

* cited by examiner

FLAT PANEL DISPLAY DEVICE CONTROLLING INITIALIZATION OF DATA LINES SUPPLIED TO A PIXEL UNIT

CLAIM OF PRIORITY

This application makes reference to, incorporates the same herein, and claims all benefits accruing under 35 U.S.C. §119 from an application earlier filed in the Korean Intellectual Property Office on Jan. 10, 2013 and there duly assigned Serial No. 10-2013-0002733.

BACKGROUND OF THE INVENTION

1. Field of the Invention

Example embodiments relate generally to a flat panel display device. More particularly, embodiments of the inventive concept relate to a flat panel display device having a demultiplexing unit that performs a demultiplexing operation on combined signals (i.e., a data signal) output from a data driver.

2. Description of the Related Art

Instead of a cathode-ray tube (CRT) display device, a flat panel display device has been widely used as a display device of an electronic device. For example, the flat panel display device includes an organic light emitting display (OLED) device, a liquid crystal display (LCD) device, a plasma display panel (PDP) device, etc.

The organic light emitting display device displays an image using an organic light emitting diode that emits light. Thus, the organic light emitting display device is manufactured in a thinner shape because the organic light emitting display device do not include an additional light source unlike the liquid crystal display device. In addition, the organic light emitting display device has advantages of low power consumption, high luminance, fast response speed, etc., compared to the liquid crystal display device.

Generally, pixels of the flat panel display device are coupled to data-lines for applying a data signal to the pixels, and to scan-lines for applying a scan signal to the pixels. In the flat panel display device, respective pixels coupled to one data-line are coupled to different scan-lines, and respective pixels coupled to one scan-line are coupled to different data-lines.

Thus, increasing a quantity of the pixels to increase a resolution of the flat panel display device may result in increasing a quantity of the data-lines and/or a quantity of the scan-lines. As a result, a manufacturing cost of the flat panel display device may increase because a quantity of circuits included in a data driver that generates and outputs the data signal increases when a quantity of the data-lines increases.

To solve these problems, a demultiplexing-technique for reducing a quantity of circuits included in the data driver has been suggested. According to the demultiplexing-technique, a demultiplexing unit (i.e., includes at least one demultiplexer (DEMUX)) performs a demultiplexing operation on the data signal having combined signals, and then sequentially applying the combined signals to the data-lines.

Generally, in order to prevent, during a current horizontal period, a distortion of the data signal due to an influence of the data signal that is applied via the data-lines during a previous horizontal period, the multiplexing unit performs the demultiplexing operation by dividing one horizontal period into a first period during which the data signal is applied to the data-lines, and a second period during which the data signal applied to the data-lines is applied to the pixels as the scan signal is applied to the pixels.

However, one horizontal period decreases as a resolution of the flat panel display device increases. That is, a period during which the scan signal is applied to the pixels decreases in one horizontal period as the resolution of the flat panel display device increases. Particularly, when the flat panel display device includes a compensating circuit that compensates a threshold voltage in the period during which the scan signal is applied to the pixels in order to prevent an image-quality degradation of respective pixels, a Mura phenomenon may occur because the threshold voltage cannot be properly compensated as the period during which the scan signal is applied to the pixels decreases.

SUMMARY OF THE INVENTION

Some example embodiments provide a flat panel display device capable of obtaining an adequate time during which a scan signal is applied to pixels to provide an improved image-quality by including a demultiplexing unit that applies a data signal to the pixels via data-lines while the scan signal is applied to the pixels.

According to some example embodiments, a flat panel display device may include a pixel unit having scan-lines, data-lines, and first through third pixels that are coupled to the scan-lines and the data-lines, a scan driver that applies a scan signal to the pixel unit, a data driver that selectively applies a first data signal, a second data signal, a third data signal, and an initialization signal to the pixel unit, a demultiplexing unit that applies the first data signal, the second data signal, and the third data signal to the first pixels, the second pixels, and the third pixels, respectively, and that simultaneously applies the initialization signal to the first through third pixels, the demultiplexing unit having at least one demultiplexer, and a timing control unit that controls the scan driver, the data driver, and the demultiplexing unit.

In example embodiments, the flat panel display device may further include a plurality of capacitors that store respective voltages corresponding to the first data signal, the second data signal, the third data signal, and the initialization signal, the capacitors being coupled to the data-lines, respectively.

In example embodiments, a voltage level of the initialization signal may be smaller than or equal to respective voltage levels of the first data signal, the second data signal, and the third data signal.

In example embodiments, the data driver may directly apply at least one of the first data signal, the second data signal, and the third data signal to the pixel unit.

In example embodiments, the demultiplexer may include a plurality of switches configured to perform a coupling operation between the data driver and the data-lines based on a control signal output from the timing control unit, and a plurality of control-lines that apply the control signal to the switches.

In example embodiments, the timing control unit may control the data driver and the demultiplexing unit to simultaneously apply the initialization signal to the first through third pixels to initialize the data-lines coupled to the first through third pixels, and to sequentially apply the first data signal, the second data signal, and the third data signal to the first pixels, the second pixels, and the third pixels, respectively, during one horizontal period.

In example embodiments, the timing control unit may control the scan driver to apply the scan signal to the first through third pixels after the data-lines are initialized, during the one horizontal period.

According to some example embodiments, a flat panel display device may include a pixel unit having scan-lines, data-lines, and first through third pixels that are coupled to the scan-lines and the data-lines, a scan driver that applies a scan signal to the pixel unit, a data driver that selectively applies a first data signal, a second data signal, a third data signal, and an initialization signal to the pixel unit, a demultiplexing unit that applies the first data signal, the second data signal, and the third data signal to the first pixels, the second pixels, and the third pixels, respectively, and that selectively applies the initialization signal to the first through third pixels, the demultiplexing unit having at least one demultiplexer, and a timing control unit that controls the scan driver, the data driver, and the demultiplexing unit.

In example embodiments, the flat panel display device may further include a plurality of capacitors that store respective voltages corresponding to the first data signal, the second data signal, the third data signal, and the initialization signal, the capacitors being coupled to the data-lines, respectively.

In example embodiments, a voltage level of the initialization signal may be smaller than or equal to respective voltage levels of the first data signal, the second data signal, and the third data signal.

In example embodiments, the data driver may directly apply at least one of the first data signal, the second data signal, and the third data signal to the pixel unit.

In example embodiments, the demultiplexer may include a plurality of switches that perform a coupling operation between the data driver and the data-lines based on a control signal output from the timing control unit, and a plurality of control-lines that apply the control signal to the switches.

In example embodiments, the timing control unit may control the data driver and the demultiplexing unit to apply the first data signal to the first pixels, to apply the initialization signal to the first pixels to initialize the data-lines coupled to the first pixels, to apply the second data signal to the second pixels, to apply the initialization signal to the second pixels to initialize the data-lines coupled to the second pixels, to apply the third data signal to the third pixels, and to apply the initialization signal to the third pixels to initialize the data-lines coupled to the third pixels, during one horizontal period.

In example embodiments, the timing control unit may control the scan driver to apply the scan signal to the first through third pixels after at least one of the data-lines are initialized, during the one horizontal period.

Therefore, a flat panel display device according to example embodiments may obtain an adequate time during which a scan signal is applied to pixels by controlling a demultiplexing unit to apply a data signal combined with an initialization signal to the pixels via data-lines while the scan signal is applied to the pixels. As a result, the flat panel display device may provide an improved image-quality.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
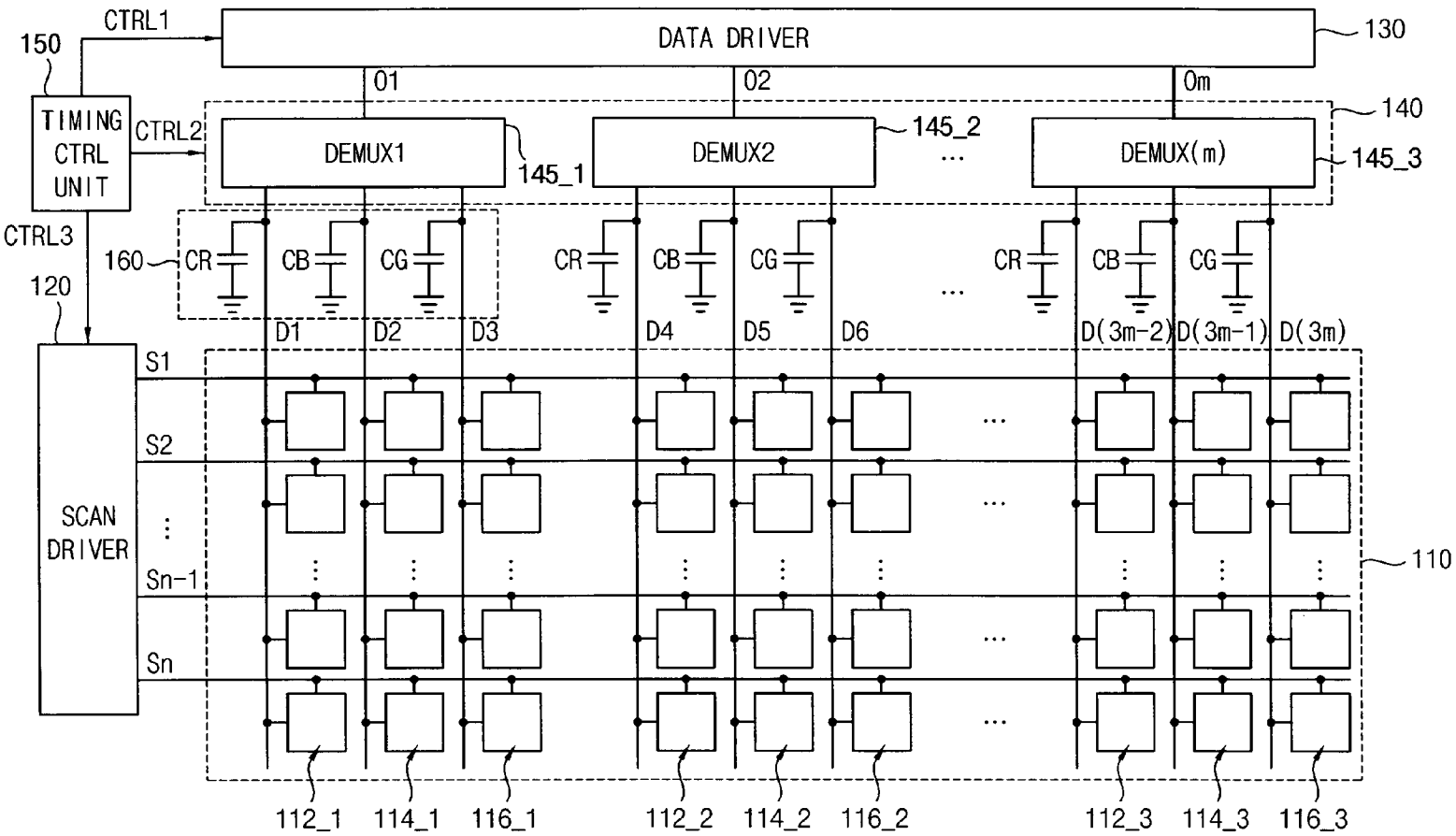
FIG. 1 is a block diagram illustrating a flat panel display device according to example embodiments.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a flat panel display device according to example embodiments.

Referring to FIG. 1, the flat panel display device 100 may include a pixel unit 110, a scan driver 120, a data driver 130, a demultiplexing unit 140, and a timing control unit 150. In some example embodiments, the flat panel display device 100 may further include capacitors 160 for storing a voltage (i.e., voltage level) that is applied to data-lines D1 through D(3*m*).

The pixel unit 110 may include first data-lines D1, D4, and D(3*m*−2) that transmit a first data signal, second data-lines D2, D5, and D(3*m*−1) that transmit a second data signal, third data-lines D3, D6, and D(3*m*) that transmit a third data signal, scan-lines S1 through Sn that transmit a scan signal, and pixels 112, 114, and 116 that are coupled to the data-lines D1 through D(3*m*) and the scan-lines S1 through Sn).

The pixels may include first pixels 112 that are coupled to the first data-lines D1, D4, and D(3*m*−2), second pixels 114 that are coupled to the second data-lines D2, D5, and D(3*m*−1), and third pixels 116 that are coupled to the third data-lines D3, D6, and D(3*m*−1).

The scan driver 120 may generate the scan signal in response to a control signal CTRL3 output from the timing control unit 150, and may sequentially apply the scan signal to the pixels 112, 114, and 116 via the scan-lines S1 through Sn.

The data driver 130 may selectively generate a first data signal, a second data signal, a third data signal, and an initialization signal in response to a control signal CTRL1 output from the timing control unit 150, and may transmit the first data signal, the second data signal, the third data signal, and the initialization signal to the demultiplexing unit 140 (i.e., the demultiplexers 145) via transmission-lines 01 through 0*m*. Depending on operations of the demultiplexing unit 140 based on a control signal CTRL2 output from the timing control unit 150, the data driver 130 may selectively apply the first data signal, the second data signal, the third data signal, and the initialization signal to the pixel unit 110 via the demultiplexers 145 (i.e., 145_1, 145_2, and 145_3).

For example, the first data signal (via first data-lines D1, D4, and D(3*m*−2)) may correspond to a signal related to red color pixels emitting a red color light, the second data signal (via second data-lines D2, D5, and D(3*m*−1)) may correspond to a signal related to blue color pixels emitting a blue color light, and the third data signal (via third data-lines D3, D6, and D(3*m*−1)) may correspond to a signal related to green color pixels emitting a green color light.

In some example embodiments, the first data signal may correspond to a signal related to selected red color pixels emitting a red color light, the second data signal may correspond to a signal related to peripheral red color pixels of the selected red color pixels, and the third data signal may correspond to a signal related to other peripheral red color pixels of the selected red color pixels. Similarly, the first data signal may correspond to a signal related to selected blue color pixels emitting a blue color light, the second data signal may correspond to a signal related to peripheral blue color pixels of the selected blue color pixels, and the third data signal may correspond to a signal related to other peripheral blue color pixels of the selected blue color pixels. Similarly, the first data signal may correspond to a signal related to selected green color pixels emitting a green color light, the second data signal may correspond to a signal related to peripheral green color pixels of the selected green color pixels, and the third data signal may correspond to a signal related to other peripheral green color pixels of the selected green color pixels. That is, a demultiplexing operation may be performed on data signals related to the same color (i.e., related to a selected pixel and its peripheral pixels that emit the same color light). As a result, the flat panel display device 100 may reduce power consumption by performing the demultiplexing operation on the data signals related to the same color.

The initialization signal may initialize a voltage level of the data-lines D1 through D(3*m*) included in the pixel unit 110. A voltage level of the initialization signal may be smaller than or equal to respective voltage levels of the first data signal, the second data signal, and the third data signal.

The pixels 112, 114, and 116 may have a pixel structure in which threshold voltage compensation is performed by diode-coupling of a driving transistor. In the pixel structure, when the voltage level of the initialization signal is smaller than respective voltage levels of the first through third data signals, the voltage level of the data-lines D1 through D(3*m*) coupled to the pixels may be initialized if the initialization signal is applied after the voltage level of the first through third data signals is written in the pixels. However, the voltage level of the initialization signal may not be written in the pixels due to the pixel structure because the voltage level of the initialization signal is smaller than respective voltage levels of the first through third data signals.

The demultiplexing unit 140 may include at least one demultiplexer 145. In addition, the demultiplexing unit 140 may perform the demultiplexing operation on the signals generated by the data driver 130 in response to a control signal CTRL2 output from the timing control unit 150.

In one example embodiment, the demultiplexing unit 140 may apply the first data signal generated by the data driver 130 to the first pixels 112, may apply the second data signal generated by the data driver 130 to the second pixels 114, may apply the third data signal generated by the data driver 130 to the third pixels 116, and may simultaneously apply the initialization signal generated by the data driver 130 to the first through third pixels 112, 114, and 116.

In another example embodiment, the demultiplexing unit 140 may apply the first data signal generated by the data driver 130 to the first pixels 112, may apply the second data signal generated by the data driver 130 to the second pixels 114, may apply the third data signal generated by the data driver 130 to the third pixels 116, and may selectively apply the initialization signal generated by the data driver 130 to the first through third pixels 112, 114, and 116.

The timing control unit 150 may control the data driver 130 using the first control signal CTRL1, may control the demultiplexing unit 140 using the second control signal CTRL2, and may control the scan driver 120 using the third control signal CTRL3.

The capacitors 160 may be coupled to the data-lines D1 through D(3*m*), respectively. The capacitors 160 may store respective voltages corresponding to the first data signal, the second data signal, the third data signal, and the initialization signal. The capacitors 160 may correspond to an element caused by parasitic capacitances of the data-lines D1 through D(3*m*) or the demultiplexing unit 140.

Figure 2:
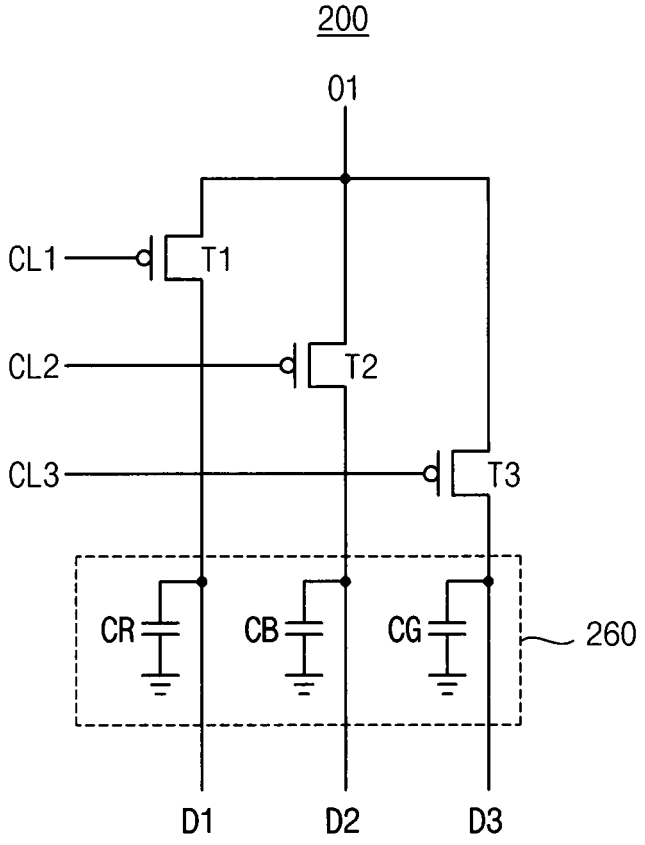
FIG. 2 is a circuit diagram illustrating an example of one demultiplexer included in a demultiplexing unit of a flat panel display device of FIG. 1.

FIG. 2 is a circuit diagram illustrating an example of one demultiplexer included in a demultiplexing unit of a flat panel display device of FIG. 1.

Referring to FIG. 2, the demultiplexer 200 (i.e., corresponding to the demultiplexer 145_1 included in the demultiplexing unit 140 of the flat panel display device 100) may be electrically coupled to the first transmission-line 01 of the data driver 130, and may be controlled by the second control signal CTRL2 output from the timing control unit 150 of the flat panel display device 100.

The demultiplexer 200 may include the first data-line D1 coupled to the first pixels 112 of the pixel unit 110, the second data-line D2 coupled to the second pixels 114 of the pixel unit 110, the third data-line D3 coupled to the third pixels 116 of the pixel unit 110, a first switching transistor T1 placed between the first transmission-line 01 and the first data-line D1, a second switching transistor T2 placed between the first transmission-line 01 and the second data-line D2, and a third switching transistor T3 placed between the first transmission-line 01 and the third data-line D3. Although it is illustrated that the first through third switching transistor T1, T2, and T3 are implemented by p-channel metal oxide semiconductor (PMOS) transistors, the first through third switching transistor T1, T2, and T3 may be implemented by n-channel metal oxide semiconductor (NMOS) transistors.

In some example embodiments, the demultiplexer 200 may further include capacitors 260 that store respective voltages of the first through third data-lines D1, D2, and D3. The capacitors 260 may correspond to an element caused by parasitic capacitances CR, CB, and CG of the first through third data-lines D1 through D3.

Here, the first switching transistor T1 may be controlled by a first switching signal included in the second control signal CTRL2, where the first switching signal is applied via a first control-line CL1, the second switching transistor T2 may be controlled by a second switching signal included in the second control signal CTRL2, where the second switching signal is applied via a second control-line CL2, and the third switching transistor T3 may be controlled by a third switching signal included in the second control signal CTRL2, where the third switching signal is applied via a third control-line CL3.

Specifically, when the first through third switching signals have a logic low level, the first through third switching transistors T1, T2, and T3 may turn-on, respectively. In this case, the first through third switching transistors T1, T2, and T3 may apply signals input from the first transmission-line 01 to the first through third data-lines D1, D2, and D3, respectively. On the other hand, when the first through third switching signals have a logic high level, the first through third switching transistors T1, T2, and T3 may turn-off, respectively. In this case, the first through third switching transistors T1, T2, and T3 may not apply signals input from the first transmission-line 01 to the first through third data-lines D1, D2, and D3, respectively.

Therefore, the timing control unit 150 of the flat panel display device 100 may control the demultiplexer 200 to perform the demultiplexing operation on signals generated by the data driver 130 using the first through third switching signals constituting the second control signal CTRL2.

Figure 3A:
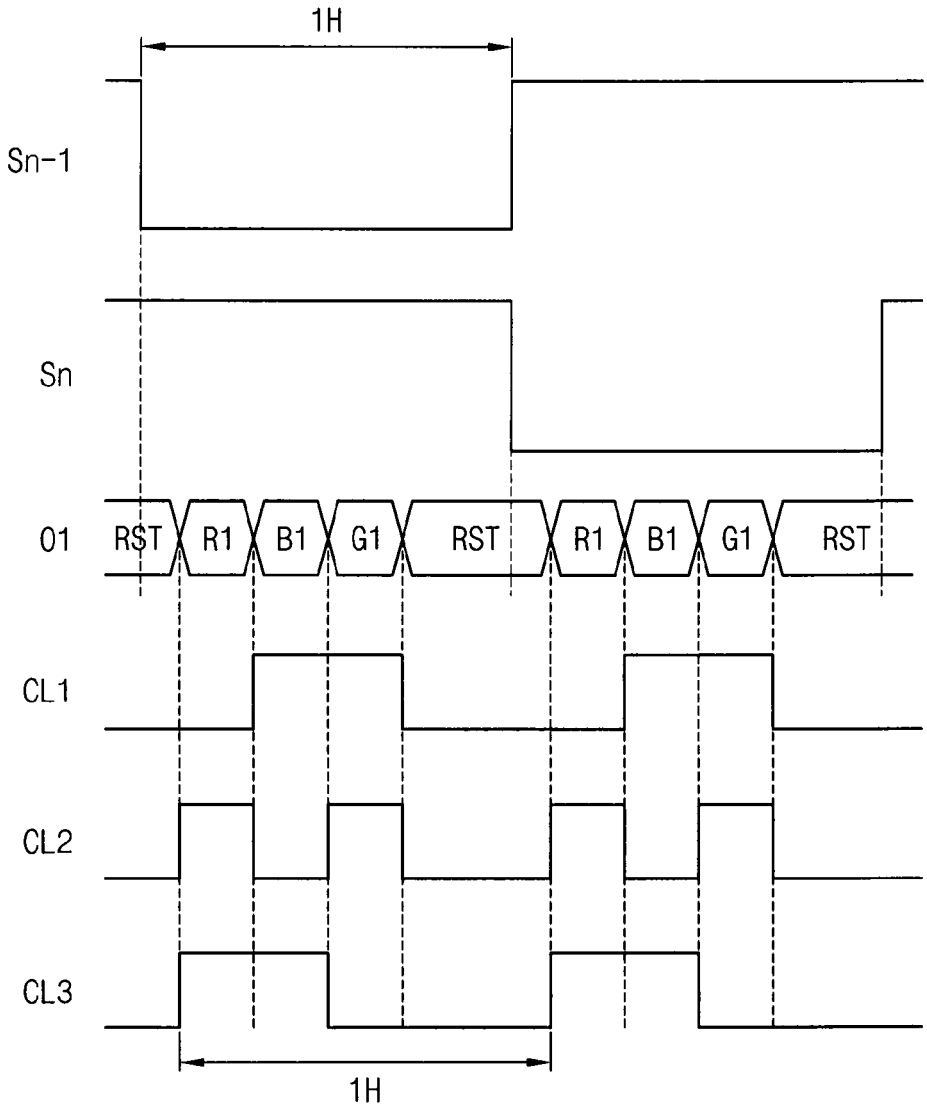
FIG. 3A is a timing diagram illustrating an example in which a signal is applied to a flat panel display device of FIG. 1.

FIG. 3A is a timing diagram illustrating an example in which a signal is applied to a flat panel display device of FIG. 1.

Referring to FIG. 3A, an example in which the flat panel display device operates is illustrated in detail. During one horizontal period 1H, a timing control unit may control a data driver and a demultiplexer to simultaneously apply an initialization signal RST to first through third pixels to initialize first through third data-lines coupled to the first through third pixels, and then to sequentially apply a first data signal R1 to the first pixels (i.e., the first data-lines), a second data signal B1 to the second pixels (i.e., the second data-lines), and a third data signal G1 to the third pixels (i.e., the third data-lines).

Meanwhile, during one horizontal period 1H, the timing control unit may control a scan driver to apply a scan signal to the first through third pixels via a scan-line Sn−1 or Sn after the first through third data-lines are initialized by the initialization signal RST.

Specifically, when the initialization signal RST is applied to the demultiplexer via a first transmission-line 01, the timing control unit may apply a signal having a logic low level to first through third control-lines CL1, CL2, and CL3 of the demultiplexer. As a result, all data-lines coupled to the demultiplexer may be initialized.

Subsequently, when the first data signal R1 is applied to the demultiplexer via the first transmission-line 01, the timing control unit may apply a signal having a logic low level to the first control-line CL1 of the demultiplexer, and may apply a signal having a logic high level to the second and third control-lines CL2 and CL3 of the demultiplexer. As a result, the demultiplexer may apply the first data signal R1 to the first pixels via the first data-lines.

In addition, when the second data signal B1 is applied to the demultiplexer via the first transmission-line 01, the timing control unit may apply a signal having a logic low level to the second control-line CL2 of the demultiplexer, and may apply a signal having a logic high level to the first and third control-lines CL1 and CL3 of the demultiplexer. As a result, the demultiplexer may apply the second data signal B1 to the second pixels via the second data-lines.

Further, when the third data signal G1 is applied to the demultiplexer via the first transmission-line 01, the timing control unit may apply a signal having a logic low level to the third control-line CL3 of the demultiplexer, and may apply a signal having a logic high level to the first and second control-lines CL1 and CL2 of the demultiplexer. As a result, the demultiplexer may apply the third data signal G1 to the third pixels via the third data-lines.

Since the scan signal having a logic low level is applied to the scan-line Sn−1 or Sn after the first through third data-lines are fully initialized by the initialization signal RST, the first through third data signals that are applied via the first through third data-lines during a previous horizontal period 1H may not be applied to the first through third pixels during a current horizontal period 1H.

Therefore, the flat panel display device may obtain an adequate time during which the scan signal is applied to the pixels because the flat panel display device applies the data signal to the pixels via the data-lines while the scan signal is applied to the pixels. As a result, the flat panel display device may have an improved image-quality.

Figure 3B:
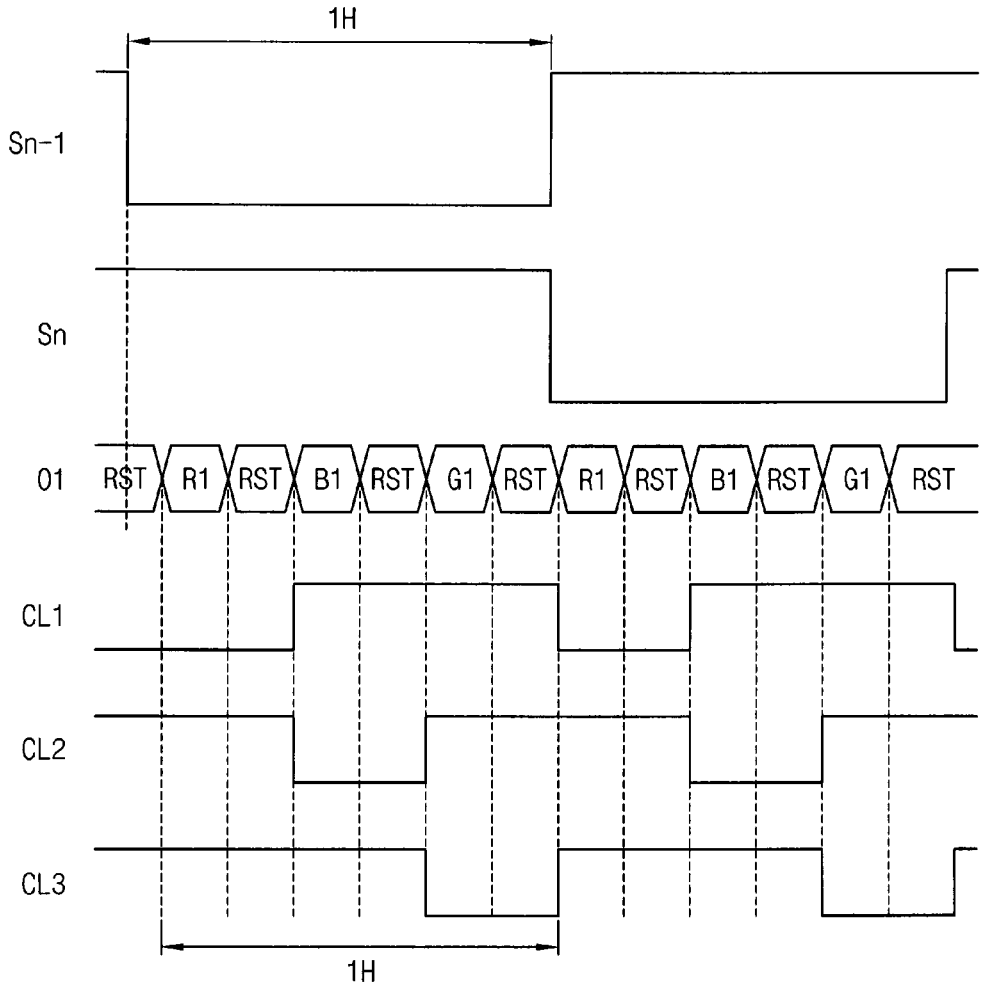
FIG. 3B is a timing diagram illustrating another example in which a signal is applied to a flat panel display device of FIG. 1.

FIG. 3B is a timing diagram illustrating another example in which a signal is applied to a flat panel display device of FIG. 1.

Referring to FIG. 3B, another example in which the flat panel display device operates is illustrated in detail. During one horizontal period 1H, a timing control unit may control a data driver and a demultiplexer to apply a first data signal R1 to first pixels, to apply an initialization signal RST to the first pixels to initialize first data-lines coupled to the first pixels, to apply a second data signal B1 to second pixels, to apply the initialization signal RST to the second pixels to initialize second data-lines coupled to the second pixels, to apply a third data signal G1 to third pixels, and then to apply the initialization signal RST to the third pixels to initialize third data-lines coupled to the third pixels.

Meanwhile, during one horizontal period 1H, the timing control unit may control a scan driver to apply a scan signal to the first through third pixels via a scan-line Sn−1 or Sn after one of the first through third data-lines is initialized by the initialization signal RST.

Specifically, when the first data signal R1 is applied to the demultiplexer via a first transmission-line 01, the timing control unit may apply a signal having a logic low level to a first control-line CL1 of the demultiplexer, and may apply a signal having a logic high level to second and third control-lines CL2 and CL3 of the demultiplexer. As a result, the demultiplexer may apply the first data signal R1 to the first pixels via the first data-lines.

Subsequently, when the initialization signal RST is applied to the demultiplexer via the first transmission-line 01, the timing control unit may apply a signal having a logic low level to the first control-line CL1 of the demultiplexer, and may apply a signal having a logic high level to the second and third control-lines CL2 and CL3. As a result, the demultiplexer may initialize the first data-lines. However, in a pixel structure in which threshold voltage compensation is performed by diode-coupling of a driving transistor, when a voltage level of the initialization signal RST is smaller than respective voltage levels of first data signal, second data signal, and third data signal, the voltage level of the initialization signal RST may not be written in the pixels due to the pixel structure if the initialization signal RST is applied after the voltage level of the first data signal is written in the pixels.

In addition, when the second data signal B1 is applied to the demultiplexer via the first transmission-line 01, the timing control unit may apply a signal having a logic low level to the second control-line CL2 of the demultiplexer, and may apply a signal having a logic high level to the first and third control-lines CL1 and CL3 of the demultiplexer. As a result, the demultiplexer may apply the second data signal B1 to the second pixels via the second data-lines.

Subsequently, when the initialization signal RST is applied to the demultiplexer via the first transmission-line 01, the timing control unit may apply a signal having a logic low level to the second control-line CL2 of the demultiplexer, and may apply a signal having a logic high level to the first and third control-lines CL1 and CL3. As a result, the demultiplexer may initialize the second data-lines. However, the voltage level of the initialization signal RST may not be written in the pixels due to the pixel structure.

Further, when the third data signal G1 is applied to the demultiplexer via the first transmission-line 01, the timing control unit may apply a signal having a logic low level to the third control-line CL3 of the demultiplexer, and may apply a signal having a logic high level to the first and second control-lines CL1 and CL2 of the demultiplexer. As a result, the demultiplexer may apply the third data signal G1 to the third pixels via the third data-lines.

Subsequently, when the initialization signal RST is applied to the demultiplexer via the first transmission-line 01, the timing control unit may apply a signal having a logic low level to the third control-line CL3 of the demultiplexer, and may apply a signal having a logic high level to the second and third control-lines CL2 and CL3. As a result, the demultiplexer may initialize the third data-lines. However, the voltage level of the initialization signal RST may not be written in the pixels due to the pixel structure.

Since the scan signal having a logic low level is applied to the scan-line Sn−1 or Sn after one of the first through third data-lines is fully initialized by the initialization signal RST, the first through third data signals that are applied via the first through third data-lines during a previous horizontal period 1H may not be applied to the first through third pixels during a current horizontal period 1H.

Therefore, the flat panel display device may obtain an adequate time during which the scan signal is applied to the pixels because the flat panel display device applies the data signal to the pixels via the data-lines while the scan signal is applied to the pixels. As a result, the flat panel display device may have an improved image-quality.

Figure 4:
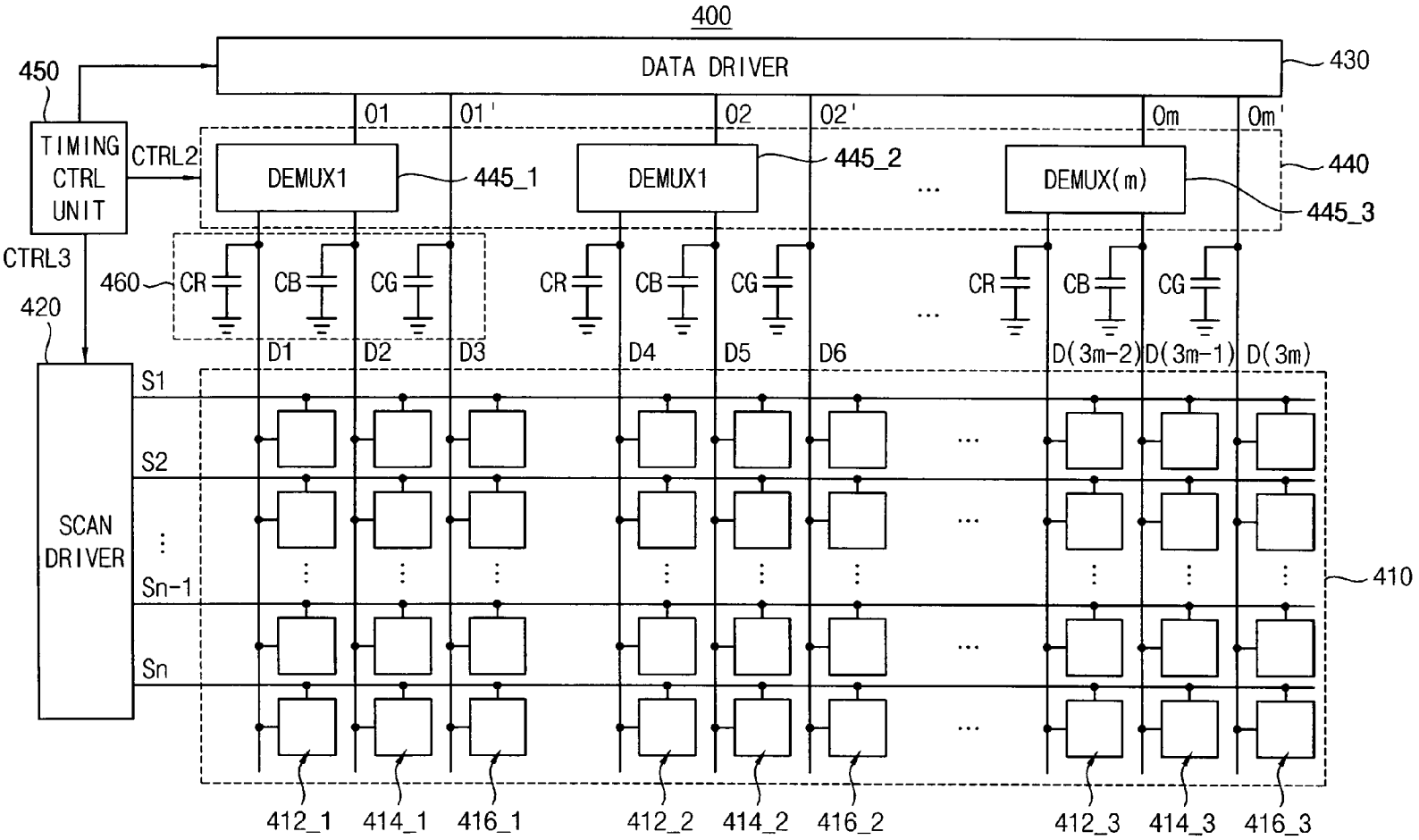
FIG. 4 is a block diagram illustrating a flat panel display device according to example embodiments.

FIG. 4 is a block diagram illustrating a flat panel display device according to example embodiments.

Referring to FIG. 4, the flat panel display device 400 may include a pixel unit 410, a scan driver 420, a data driver 430, a demultiplexing unit 440, and a timing control unit 450. In some example embodiments, the flat panel display device 400 may further include capacitors 460 for storing a voltage (i.e., voltage level) that is applied to data-lines D1 through D(3*m*).

Except for data-lines D3, D6, and D(3*m*) that are directly coupled to the data driver 430 (i.e., the data-lines D3, D6, and D(3*m*) are not coupled to demultiplexers 445 included in the demultiplexing unit 440), a structure of the flat panel display device 400 may be similar to a structure of the flat panel display device 100 of FIG. 1.

The data driver 430 may selectively generate a first data signal, a second data signal, and an initialization signal in response to a control signal CTRL1 output from the timing control unit 450, and may transmit the first data signal, the second data signal, and the initialization signal to the demultiplexing unit 440 (i.e., the demultiplexers 445) via transmission-lines 01 through 0*m*. Depending on operations of the demultiplexing unit 440 based on a control signal CTRL2 output from the timing control unit 450, the data driver 430 may selectively apply the first data signal, the second data signal, and the initialization signal to the pixel unit 410 (i.e., first pixels 412 and second pixels 414) via the demultiplexers 445 (i.e., 445_1, 445_2, and 445_3).

In addition, the data driver 430 may generate a third data signal in response to the control signal CTRL1 output from the timing control unit 450, and may output the third data signal to transmission-lines 01', 02', and 0*m*'. Thus, the third data signal may be applied to the pixel unit 410 (i.e., third pixels 416) via data-lines D3, D6, and D(3*m*) (i.e., the transmission-lines 01', 02', and 0*m*').

The demultiplexing unit 440 may include at least one demultiplexer 445. In addition, the demultiplexing unit 440 may perform a demultiplexing operation on the signals generated by the data driver 430 in response to the control signal CTRL2 output from the timing control unit 450.

In one example embodiment, the demultiplexing unit 440 may apply the first data signal generated by the data driver 430 to the first pixels 412, may apply the second data signal generated by the data driver 430 to the second pixels 414, and may simultaneously apply the initialization signal generated by the data driver 430 to the first and second pixels 412 and 414.

In another example embodiment, the demultiplexing unit 440 may apply the first data signal generated by the data driver 430 to the first pixels 412, may apply the second data signal generated by the data driver 430 to the second pixels 414, and may selectively apply the initialization signal generated by the data driver 430 to the first and second pixels 412 and 414.

As described above, the third data signal generated by the data driver 430 may be applied to the third pixels 416 via the data-lines D3, D6, and D(3*m*) that are directly coupled to the data driver 430.

In some example embodiments, the data-lines D3, D6, and D(3*m*) that are directly coupled to the data driver 430 may be further coupled to additional loads in order to set a load magnitude of the data-lines D3, D6, and D(3*m*) to be substantially the same as a load magnitude of the data-lines D1, D2, D4, D5, D(3*m*−2), and D(3*m*−1) that are indirectly coupled to the data driver 430 through the demultiplexing unit 440. For example, the additional loads may be implemented with demultiplexer switches.

Figure 5:
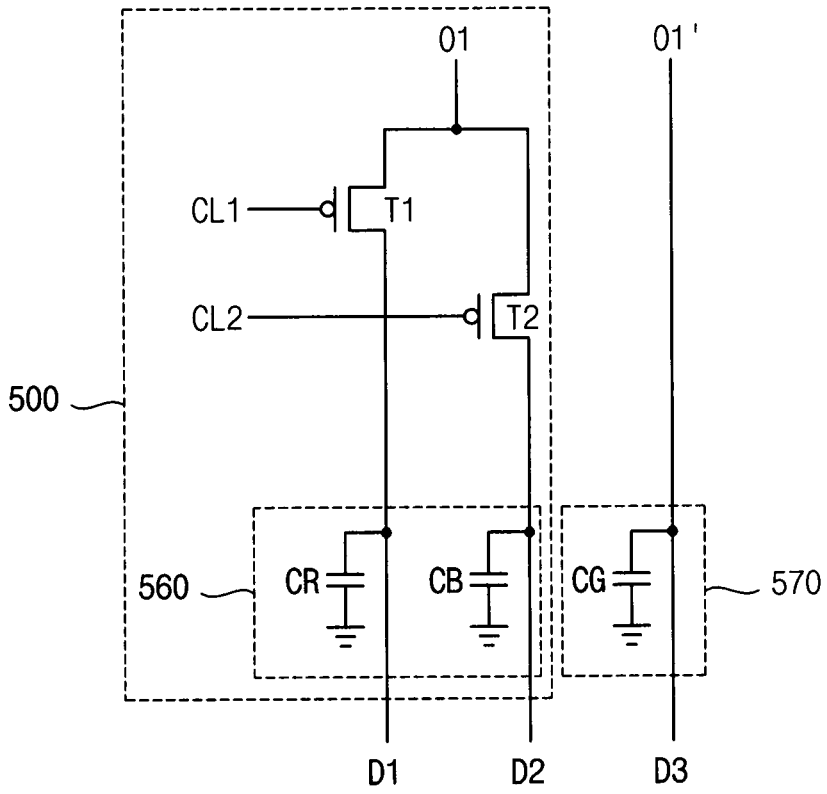
FIG. 5 is a circuit diagram illustrating an example of one demultiplexer included in a demultiplexing unit of a flat panel display device of FIG. 4.

FIG. 5 is a circuit diagram illustrating an example of one demultiplexer included in a demultiplexing unit of a flat panel display device of FIG. 4.

Referring to FIG. 5, the demultiplexer 500 (i.e., corresponding to the demultiplexer 445_1 included in the demultiplexing unit 440 of the flat panel display device 400) may be electrically coupled to the first transmission-line 01 of the data driver 430, and may be controlled by the second control signal CTRL2 output from the timing control unit 450 of the flat panel display device 400. In addition, the data-line D3 may be directly coupled to the data driver 430.

The demultiplexer 500 may include the first data-line D1 coupled to the first pixels 412 of the pixel unit 410, the second data-line D2 coupled to the second pixels 414 of the pixel unit 410, a first switching transistor T1 placed between the first transmission-line 01 and the first data-line D1, and a second switching transistor T2 placed between the first transmission-line 01 and the second data-line D2. In addition, the third data-line D3 may be coupled directly to the third pixels 416 of the pixel unit 410 via transmission-line 01'. Although it is illustrated that the first and second switching transistor T1 and T2 are implemented by PMOS transistors, the first and second switching transistor T1 and T2 may be implemented by NMOS transistors.

In some example embodiments, the demultiplexer 500 may further include capacitors 560 that store respective voltages of the first and second data-lines D1 and D2. The capacitors 560 may correspond to an element caused by parasitic capacitances CR and CB of the first and second data-lines D1 and D2.

Here, the first switching transistor T1 may be controlled by a first switching signal included in the second control signal CTRL2, where the first switching signal is applied via a first control-line CL1, and the second switching transistor T2 may be controlled by a second switching signal included in the second control signal CTRL2, where the second switching signal is applied via a second control-line CL2.

Specifically, when the first and second switching signals have a logic low level, the first and second switching transistors T1 and T2 may turn-on, respectively. In this case, the first and second switching transistors T1 and T2 may apply signals input from the first transmission-line 01 to the first and second data-lines D1 and D2, respectively. On the other hand, when the first and second switching signals have a logic high level, the first and second switching transistors T1 and T2 may turn-off, respectively. In this case, the first and second switching transistors T1 and T2 may not apply signals input from the first transmission-line 01 to the first and second data-lines D1 and D2, respectively.

Therefore, the timing control unit 450 of the flat panel display device 400 may control the demultiplexer 500 to perform the demultiplexing operation on signals generated by the data driver 430 using the first and second switching signals constituting the second control signal CTRL2.

In addition, the third data signal may be output from the data driver 430 via the transmission-line 01'. Thus, the third data signal may be directly applied to the third pixels 416 of the pixel unit 410 via the third data-line D3 (i.e., corresponding to the transmission-line 01').

In some example embodiments, the third data-line D3 that is directly coupled to the data driver 430 may include a capacitor 570 that stores a voltage of the third data-line D3. The capacitor 570 may correspond to an element caused by parasitic capacitances CG of the third data-line D3.

Figure 6A:
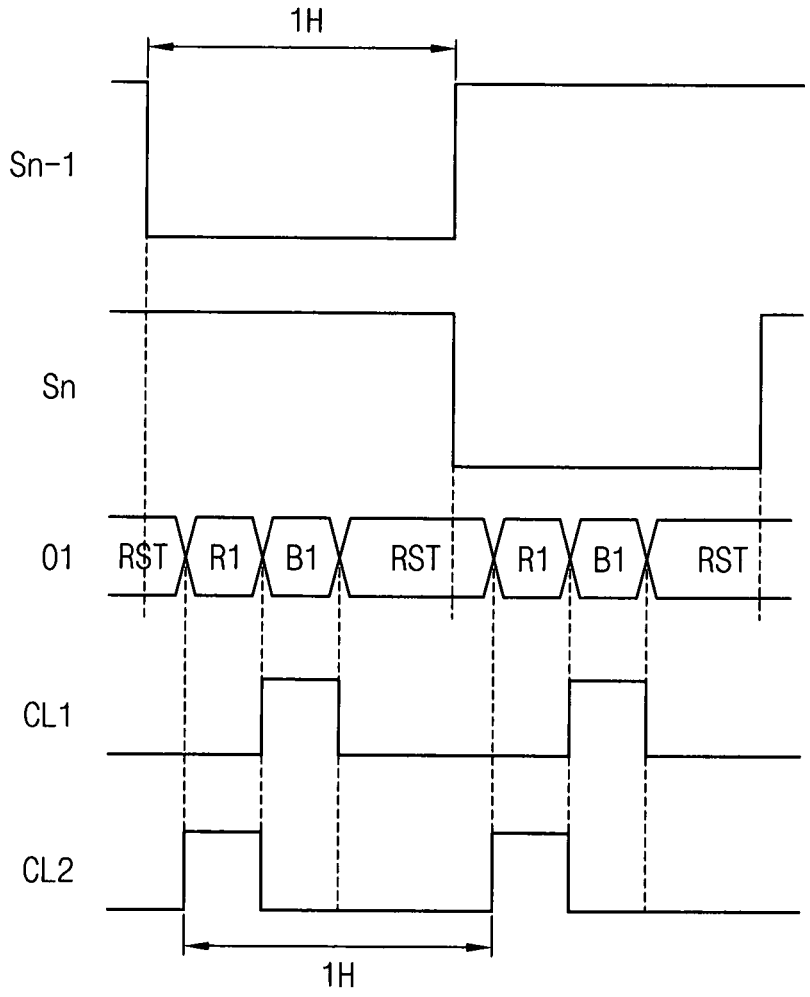
FIG. 6A is a timing diagram illustrating an example in which a signal is applied to a flat panel display device of FIG. 4.

FIG. 6A is a timing diagram illustrating an example in which a signal is applied to a flat panel display device of FIG. 4.

Referring to FIG. 6A, an example in which the flat panel display device operates is illustrated in detail. During one horizontal period 1H, a timing control unit may control a data driver and a demultiplexer to simultaneously apply an initialization signal RST to first and second pixels to initialize first and second data-lines coupled to the first and second pixels, and then to sequentially apply a first data signal R1 to the first pixels (i.e., the first data-lines) and a second data signal B1 to the second pixels (i.e., the second data-lines).

Meanwhile, during one horizontal period 1H, the timing control unit may control a scan driver to apply a scan signal to the first and second pixels via a scan-line Sn−1 or Sn after the first and second data-lines are initialized by the initialization signal RST.

Although not illustrated in FIG. 6A, the timing control unit may initialize third data-lines coupled to third pixels using the initialization signal RST, and then may apply a third data signal G1 to the third pixels. In addition, the scan signal may be applied to the third pixels via a scan-line Sn−1 or Sn after the third data-lines are initialized.

Specifically, when the initialization signal RST is applied to the demultiplexer via a first transmission-line 01, the timing control unit may apply a signal having a logic low level to first and second control-lines CL1 and CL2 of the demultiplexer. As a result, all data-lines coupled to the demultiplexer may be initialized.

Subsequently, when the first data signal R1 is applied to the demultiplexer via the first transmission-line 01, the timing control unit may apply a signal having a logic low level to the first control-line CL1 of the demultiplexer, and may apply a signal having a logic high level to the second control-line CL3 of the demultiplexer. As a result, the demultiplexer may apply the first data signal R1 to the first pixels via the first data-lines.

In addition, when the second data signal B1 is applied to the demultiplexer via the first transmission-line 01, the timing control unit may apply a signal having a logic low level to the second control-line CL2 of the demultiplexer, and may apply a signal having a logic high level to the first control-line CL1 of the demultiplexer. As a result, the demultiplexer may apply the second data signal B1 to the second pixels via the second data-lines.

Since the scan signal having a logic low level is applied to the scan-line Sn−1 or Sn after the first and second data-lines are fully initialized by the initialization signal RST, the first and second data signals that are applied via the first and second data-lines during a previous horizontal period 1H may not be applied to the first and second pixels during a current horizontal period 1H.

Therefore, the flat panel display device may obtain an adequate time during which the scan signal is applied to the pixels because the flat panel display device applies the data signal to the pixels via the data-lines while the scan signal is applied to the pixels. As a result, the flat panel display device may have an improved image-quality.

Figure 6B:
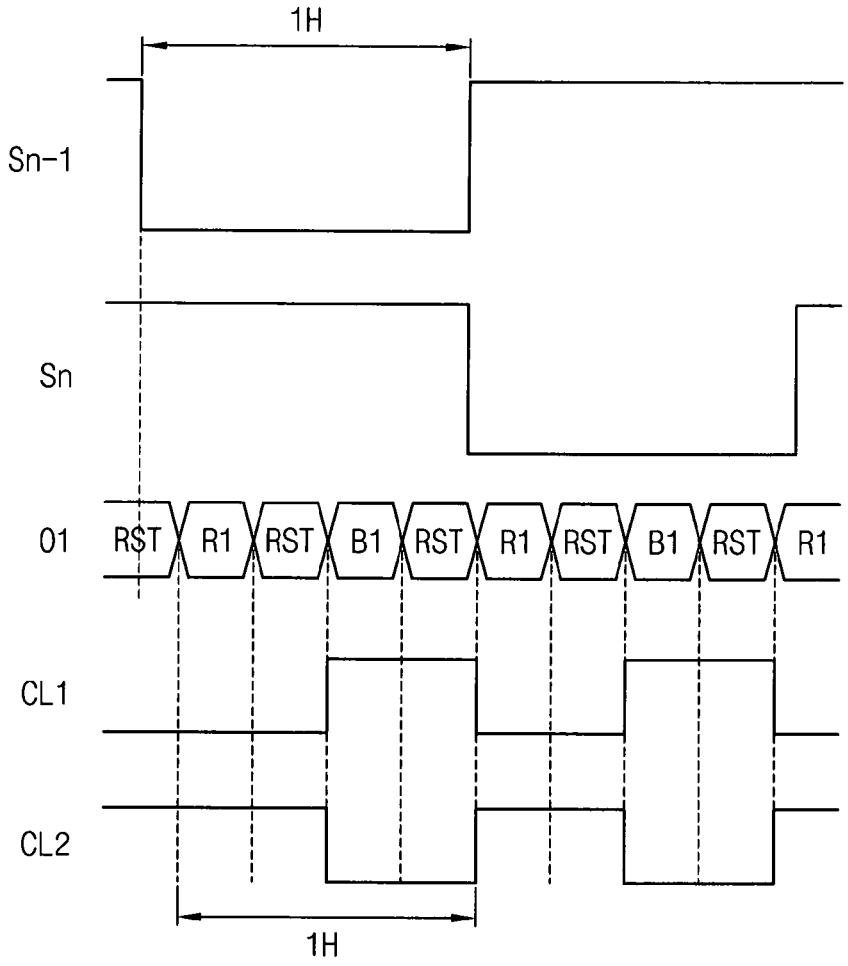
FIG. 6B is a timing diagram illustrating another example in which a signal is applied to a flat panel display device of FIG. 4.

FIG. 6B is a timing diagram illustrating another example in which a signal is applied to a flat panel display device of FIG. 4.

Referring to FIG. 6B, another example in which the flat panel display device operates is illustrated in detail. During one horizontal period 1H, a timing control unit may control a data driver and a demultiplexer to apply a first data signal R1 to first pixels, to apply an initialization signal RST to the first pixels to initialize first data-lines coupled to the first pixels, to apply a second data signal B1 to second pixels, and then to apply the initialization signal RST to the second pixels to initialize second data-lines coupled to the second pixels.

Meanwhile, during one horizontal period 1H, the timing control unit may control a scan driver to apply a scan signal to the first and second pixels via a scan-line Sn−1 or Sn after one of the first and second data-lines is initialized by the initialization signal RST.

Although not illustrated in FIG. 6B, the timing control unit may initialize third data-lines coupled to third pixels using the initialization signal RST after a third data signal is applied to the third pixels. In addition, the scan signal may be applied to the third pixels via a scan-line Sn−1 or Sn after the third data-lines are initialized.

Specifically, when the first data signal R1 is applied to the demultiplexer via a first transmission-line 01, the timing control unit may apply a signal having a logic low level to a first control-line CL1 of the demultiplexer, and may apply a signal having a logic high level to a second control-line CL2 of the demultiplexer. As a result, the demultiplexer may apply the first data signal R1 to the first pixels via the first data-lines.

Subsequently, when the initialization signal RST is applied to the demultiplexer via the first transmission-line 01, the timing control unit may apply a signal having a logic low level to the first control-line CL1 of the demultiplexer, and may apply a signal having a logic high level to the second control-line CL2. As a result, the demultiplexer may initialize the first data-lines. However, in a pixel structure in which threshold voltage compensation is performed by diode-coupling of a driving transistor, when a voltage level of the initialization signal RST is smaller than respective voltage levels of first and second data signals, the voltage level of the initialization signal RST may not be written in the pixels due to the pixel structure if the initialization signal RST is applied after the voltage level of the first data signal is written in the pixels.

In addition, when the second data signal B1 is applied to the demultiplexer via the first transmission-line 01, the timing control unit may apply a signal having a logic low level to the second control-line CL2 of the demultiplexer, and may apply a signal having a logic high level to the first control-line CL1 of the demultiplexer. As a result, the demultiplexer may apply the second data signal B1 to the second pixels via the second data-lines.

Subsequently, when the initialization signal RST is applied to the demultiplexer via the first transmission-line 01, the timing control unit may apply a signal having a logic low level to the second control-line CL2 of the demultiplexer, and may apply a signal having a logic high level to the first control-line CL1. As a result, the demultiplexer may initialize the second data-lines. However, the voltage level of the initialization signal RST may not be written in the pixels due to the pixel structure.

Since the scan signal having a logic low level is applied to the scan-line Sn−1 or Sn after one of the first and second data-lines is fully initialized by the initialization signal RST, the first and second data signals that are applied via the first and second data-lines during a previous horizontal period 1H may not be applied to the first and second pixels during a current horizontal period 1H.

Therefore, the flat panel display device may obtain an adequate time during which the scan signal is applied to the pixels because the flat panel display device applies the data signal to the pixels via the data-lines while the scan signal is applied to the pixels. As a result, the flat panel display device may have an improved image-quality.

Figure 7:
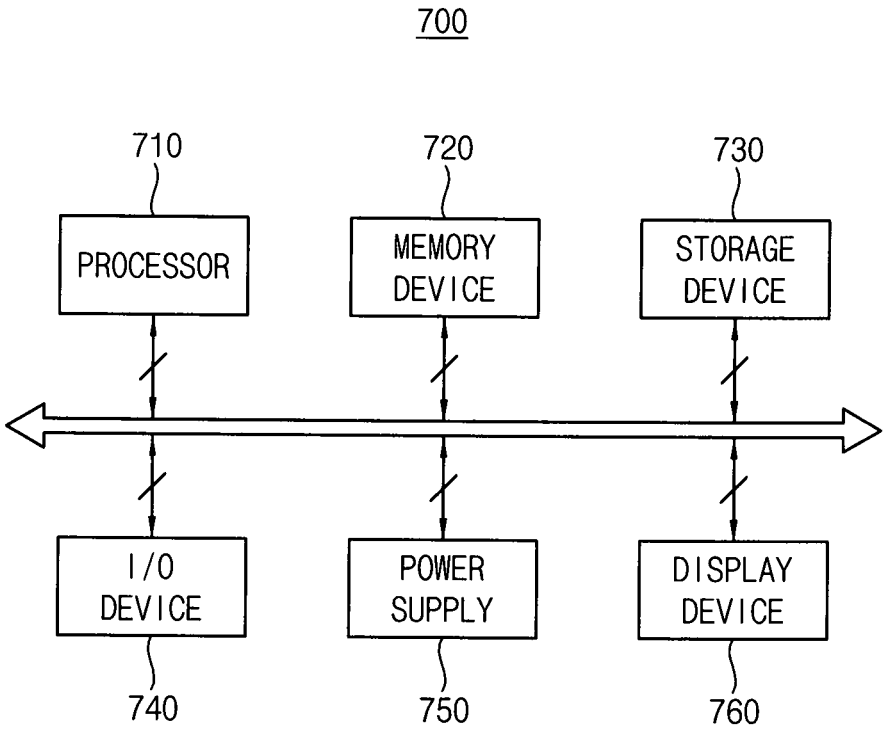
FIG. 7 is a block diagram illustrating an electronic device having a flat panel display device according to example embodiments.

FIG. 7 is a block diagram illustrating an electronic device having a flat panel display device according to example embodiments.

Referring to FIG. 7, the electronic device 700 may include a processor 710, a memory device 720, a storage device 730, an input/output (I/O) device 740, a power supply 750, and a display device 760. Here, the display device 760 may include the flat panel display device 100 of FIG. 1. In addition, the electronic device 700 may further include a plurality of ports for communicating a video card, a sound card, a memory card, a universal serial bus (USB) device, other electronic devices, etc.

The processor 710 may perform various computing functions. The processor 710 may be a micro processor, a central processing unit (CPU), etc. The processor 710 may be coupled to other components via an address bus, a control bus, a data bus, etc. Further, the processor 710 may be coupled to an extended bus such as a peripheral component interconnection (PCI) bus. The memory device 720 may store data for operations of the electronic device 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc. The storage device 730 may be a solid state drive (SSD) device, a hard disk drive (HDD) device, a CD-ROM device, etc. The I/O device 740 may be an input device such as a keyboard, a keypad, a touchpad, a mouse, etc, and an output device such as a printer, a speaker, etc. In some example embodiments, the display device 760 may be included in the I/O device 740. The power supply 750 may provide a power for operations of the electronic device 700.

As described above, the display device 760 may include a flat panel display device according to example embodiments. Here, the flat panel display device may obtain an adequate time during which a scan signal is applied to pixels by controlling a demultiplexing unit to apply a data signal combined with an initialization signal to the pixels via data-lines while the scan signal is applied to the pixels. Thus, the display device 760 may have an improved image-quality.

The present inventive concept may be applied to an electronic device having a flat panel display device. For example, the present inventive concept may be applied to a television, a computer monitor, a laptop, a digital camera, a cellular phone, a smart phone, a smart pad, a personal digital assistant (PDA), a portable multimedia player (PMP), an MP3 player, a video phone, a game console, a navigation system, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A flat panel display device comprising:

a pixel unit having scan-lines, data-lines, and first through third pixels that are coupled to the scan-lines and the data-lines;

a scan driver configured to apply a scan signal to the pixel unit;

a data driver configured to selectively apply a first data signal, a second data signal, a third data signal, and an initialization signal to the pixel unit, to directly apply one of the first data signal, the second data signal, and the third data signal to the pixel unit and;

a demultiplexing unit configured to apply the remaining two of the first data signal, the second data signal, and the third data signal to two of the first pixels, the second pixels, and the third pixels, respectively, and to simultaneously apply the initialization signal to the two of the first through third pixels, the demultiplexing unit having at least one demultiplexer; and a timing control unit configured to control the scan driver, the data driver, and the demultiplexing unit, the timing control unit applying a plurality of switching signals to the demultiplexing unit, the initialization signal being applied to the two of the first through third pixels when each of the plurality of switching signals have a same low logic level as a scan signal.

2. The device of claim 1, further comprising:

a plurality of capacitors configured to store respective voltages corresponding to the first data signal, the second data signal, the third data signal, and the initialization signal, the capacitors being coupled to the data-lines, respectively.

3. The device of claim 1, wherein a voltage level of the initialization signal is smaller than or equal to respective voltage levels of the remaining two of the first data signal, the second data signal, and the third data signal.

4. The device of claim 1, wherein the demultiplexer includes:

a plurality of switches configured to perform a coupling operation between the data driver and the data-lines based on a control signal output from the timing control unit; and a plurality of control-lines configured to apply the control signal to the switches.

5. The device of claim 1, wherein the timing control unit controls the data driver and the demultiplexing unit to simultaneously apply the initialization signal to the remaining two of the first through third pixels to initialize the data-lines coupled to the two of the first through third pixels, and to sequentially apply the two of the first data signal, the second data signal, and the third data signal to the two of the first pixels, the second pixels, and the third pixels, respectively, during one horizontal period.

6. The device of claim 5, wherein the timing control unit controls the scan driver to apply the scan signal to the two of the first through third pixels after the data-lines coupled to the two of the first through third pixels are initialized, during the one horizontal period.

7. A flat panel display device comprising:

a pixel unit having scan-lines, data-lines, and first through third pixels that are coupled to the scan-lines and the data-lines;

a scan driver configured to apply a scan signal to the pixel unit;

a data driver configured to selectively apply a first data signal, a second data signal, a third data signal, and an initialization signal to the pixel unit, and to directly apply one of the first data signal, the second data signal, and the third data signal to the pixel unit;

a demultiplexing unit configured to apply the remaining two of the first data signal, the second data signal, and the third data signal to two of the first pixels, the second pixels, and the third pixels, respectively, and to selectively apply the initialization signal to the two of the first through third pixels, the demultiplexing unit having at least one demultiplexer; and a timing control unit configured to control the scan driver, the data driver, and the demultiplexing unit.

8. The device of claim 7, wherein the demultiplexer includes:

a plurality of switches configured to perform a coupling operation between the data driver and the data-lines based on a control signal output from the timing control unit; and a plurality of control-lines configured to apply the control signal to the switches.

9. The device of claim 7, the timing control unit controlling, during one horizontal period, the data driver and the demultiplexing unit to apply the first data signal to the first pixels, and to subsequently apply the second data signal to the second pixels after applying the initialization signal to the first and second pixels to initialize the data-lines coupled to the first and second pixels, the timing control unit controlling the data driver to apply the third data signal to the third pixels, and to apply the initialization signal to the third pixels to initialize the data-lines coupled to the third pixels.

10. The device of claim 9, wherein the timing control unit controls the scan driver to apply the scan signal to the two of the first through third pixels after at least one of the data-lines are initialized, during the one horizontal period.

11. The device of claim 9, the timing control unit applying a plurality of switching signals to the demultiplexing unit, the initialization signal being applied to the first and second pixels when each of the plurality of switching signals simultaneously have a same low logic level as the scan signal.

* * * * *